United States Patent [19]

Robinson

[11] Patent Number: 4,586,917

[45] Date of Patent: May 6, 1986

[54] FILE HINGE FOLDING ASSEMBLY

[75] Inventor: Daniel T. Robinson, Greenfield, Wis.

[73] Assignee: Kempsmith Machine Co., Milwaukee, Wis.

[21] Appl. No.: 621,668

[22] Filed: Jun. 18, 1984

[51] Int. Cl.[4] ..... B31B 1/25; B31B 1/36; B31B 31/26

[52] U.S. Cl. ..... 493/241; 493/243; 493/399; 493/947

[58] Field of Search ..... 493/241, 243, 251, 397, 493/399, 438, 918, 947

[56] References Cited

U.S. PATENT DOCUMENTS

| | | | |
|---|---|---|---|
| 846,123 | 3/1907 | Mehle | 493/438 |
| 1,574,789 | 3/1926 | Burgess | 493/947 |
| 1,971,892 | 8/1934 | Anderson et al. | 493/947 |
| 2,088,805 | 8/1937 | Olm et al. | 493/947 |
| 2,649,674 | 8/1953 | Bartelt | 493/248 |
| 3,029,073 | 4/1962 | Wright | 493/399 |
| 3,127,165 | 3/1964 | Denny et al. | 493/399 |
| 4,008,650 | 2/1977 | Alter et al. | 493/241 |

*Primary Examiner*—Francis S. Husar
*Assistant Examiner*—William E. Terrell
*Attorney, Agent, or Firm*—Ronald E. Barry

[57] ABSTRACT

A folding assembly for forming a gusset in a file folder hinge and folding the file folder with the gusset inside of the file folder, the assembly including a transporting arrangement for moving a file folder in sequence through a scoring station, a creasing station, a squeezing station and a folding station, the creasing station including a drive assembly for moving one panel of the file folder toward the other as the hinge is creased. The gusset may be heated at the scoring station, creasing station and/or its squeezing station.

15 Claims, 12 Drawing Figures

FILE HINGE FOLDING ASSEMBLY

BACKGROUND OF THE INVENTION

File folders of the type contemplated herein are generally formed of two stiff panels interconnected by a flexible tape which is folded to form a gusset to provide an expansion-type hinge. These file folders have, for the most part, been hand manufactured for many years. The panels are placed on a flat surface with the edges spaced apart a fixed distance. The flexible tape is generally applied by hand to the edges of the panels. The gusset is formed by manually pressing the tape on a creasing plate to fold the tape between the panels. After the tape has been creased, the file folder is folded and stacked.

SUMMARY OF THE INVENTION

The inline folding assembly of the present invention automatically scores, creases and squeezes the tape to form the gusset, closes the file and squeezes the folded file to crease the tape in one continuous motion. The tape can be affixed to the edges of the panels by hand or automatically and fed directly into the folding assembly of the present invention. Where heat sensitive tape is used, heat may be applied during the scoring, creasing or squeezing steps to set the tape. Considerable time is saved, as well as labor, in completing the folding operation by eliminating the three manual steps previously required to complete the panel.

IN THE DRAWINGS

DESCRIPTION OF THE INVENTION

Figure 1:
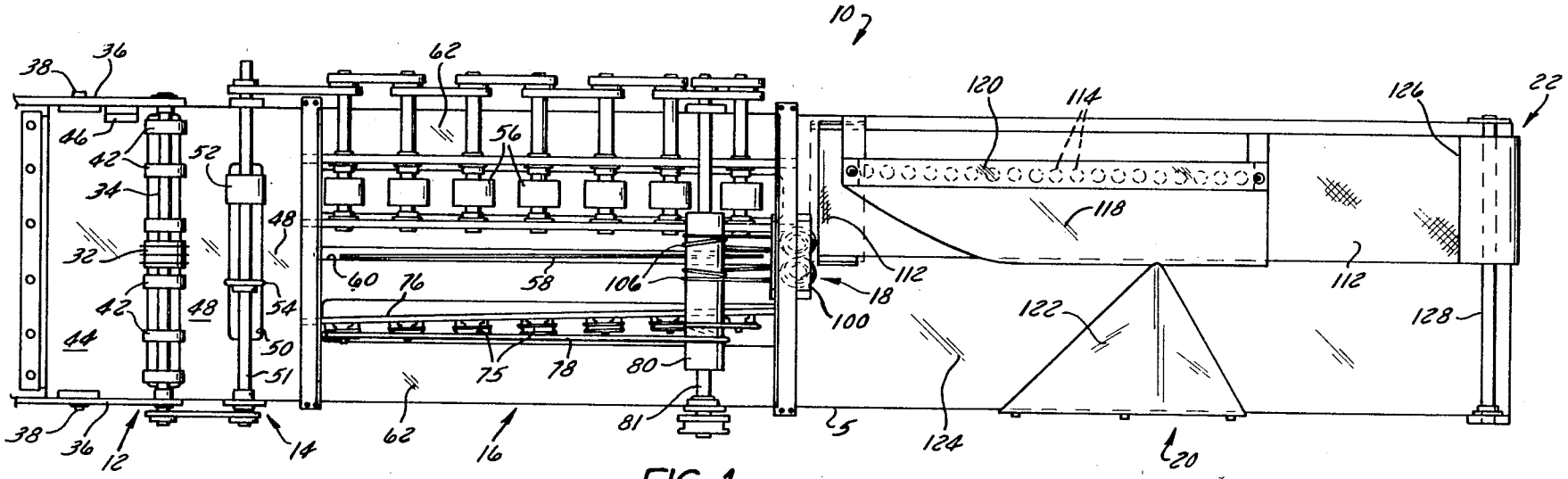
FIG. 1 is a top plan view of the folding assembly.
Figure 2:
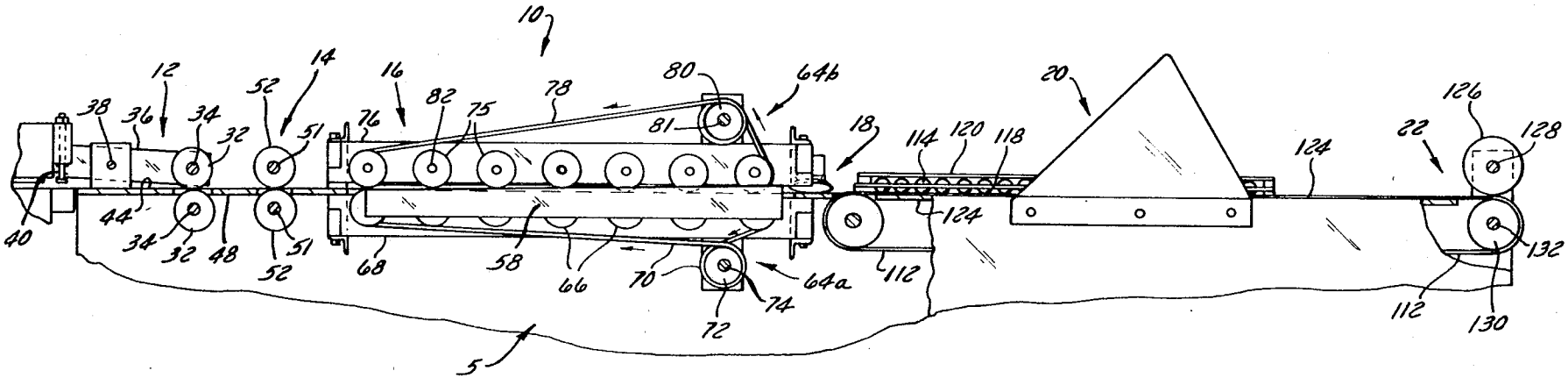
FIG. 2 is a side elevation view, partly in section, of the folding assembly.
Figure 3:
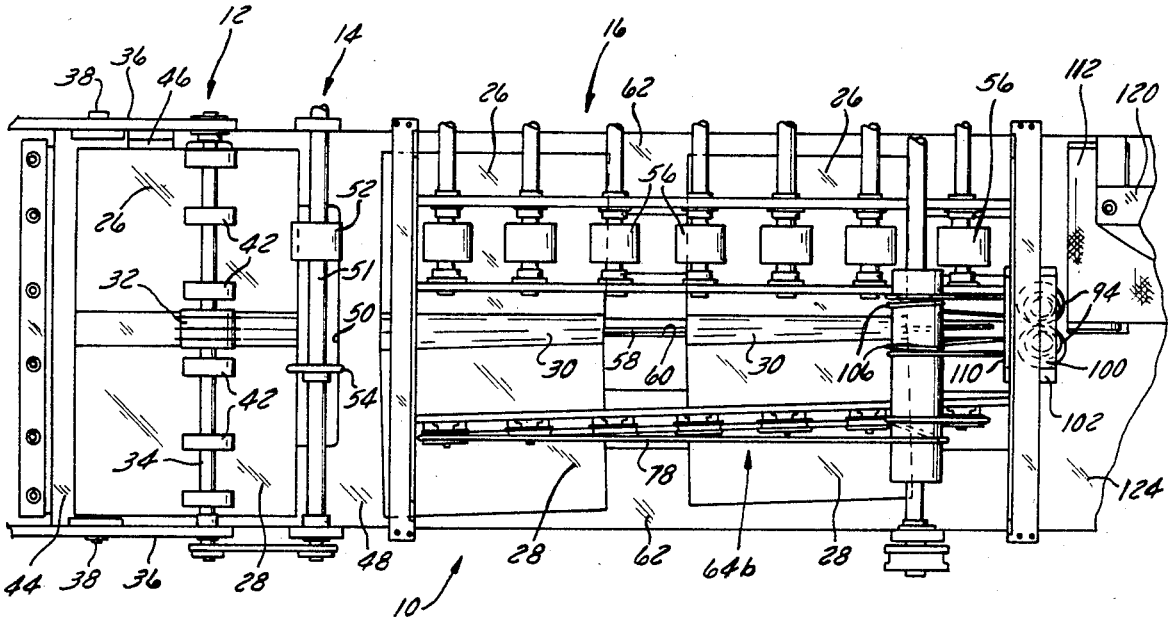
FIG. 3 is a top plan view of a portion of the folding assembly showing the file folder panels moving through the tape creasing station.
Figure 4:
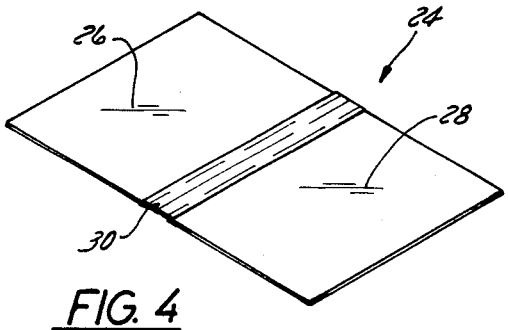
FIG. 4 is a perspective view of a file folder of the type contemplated herein showing the flexible tape attached to the panels.
Figure 5:
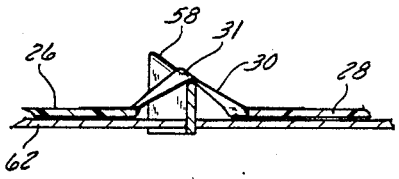
FIG. 5 is a cross-section view showing the hinged tape folded over the crease plate at the creasing station.

The inline hinge folding assembly 10 as seen in FIGS. 1 and 2 generally includes a base 5 having a scoring station 12, a drive station 14, a tape folding station 16, a fold crease station 18, a file folding station 20, and a final pressing station 22 located in sequence thereon. File folders 24 of the type contemplated herein as shown in FIG. 4 include a first panel 26, a second panel 28 and a hinge 30. The folders 24 can be fed into the scoring station 12 either manually or automatically. The file folders are driven continuously through the folding assembly with the first panel 26 on the drive side being used as the drive panel and the panel 28 on the operator's side being the driven panel. It should be noted that the second panel 28 is skewed toward the first panel 26 as the hinge is creased in the folding section.

The two stiff panels 26 and 28 which form the file folder 24 are initially spaced a distance apart and are interconnected by the tape 30. The tape is generally provided on both sides of the panels, either as two separate strips or as a single strip wrapped around the ends of the panels. The taping step is generally done by hand by placing the panels a fixed distance apart on a flat surface and then applying the tape to the edges of panels. After the taping step, the file folder is fed either manually or automatically into the folding assembly 10 and transported through the stations of the assembly by means of a number of nip rolls as described hereinafter.

The hinge 30 is initially scored by means of a pair of scoring wheels 32 provided at the scoring station 12. As seen in the drawing, the scoring wheels 32 are mounted on shafts 34 which are journaled for rotation on a pair of support arms 36. The arms 36 are mounted on pivot pins 38 and are biased by means of springs 40 to provide sufficient pressure between the scoring wheels to score the tape. If a heat sensitive tape, such as TYVEK, is used, heat may be applied to the scoring wheels 32 by means of infra red, electrical resistance, steam or hot oil as required. A number of nip wheels 42 are also provided on the shaft 34 to drive the panels 26 and 28 to the drive station 14. A skid plate 44 is provided at the front of the scoring station and a guide 46 is located on the drive side of the skid plate to align the drive panel with the scoring wheels.

The panels are fed from the scoring station onto a skid plate 48 into the drive station 14. The skid plate 48 is provided with an opening 50. The first drive panel 26 is driven through the drive station 14 by means of a pair of wide flat wheels 52 mounted on shafts 51. The drive wheels 52 are located in opening 50 and provide a wide nip so that the first panel 26 is fed straight through the drive station into the tape folding station 16. The second panel 28 is driven by means of a pair of convex wheels 54 provided on the shafts 51. The convex wheels 54 are also located in opening 50 and provide a line contact with the second panel 28 which allows the second panel 28 to be skewed or twisted with respect to the panel 26 as the file folder is fed into the folding station 16.

Figure 6:
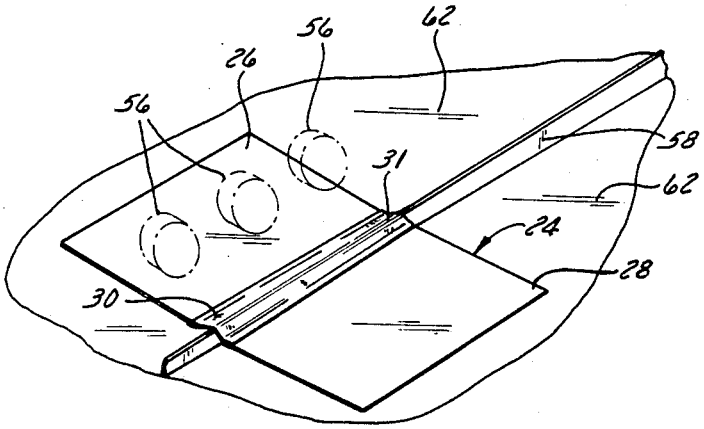
FIG. 6 is a perspective view of a portion of the creasing station showing the file folder hinge being creased by the creasing plate.

As the file folder enters the folding station 16, the drive panel 26 will be supported on skid plates 62 and driven by means of a number of wide, flat nip wheels 56 so that the first panel 26 is moved in a straight line through the folding station 16. The tape or hinge 30 will slide up a crease plate 58 which is provided in an opening 60 between the skid plates 62. The crease plate 58, as seen in FIGS. 2 and 6, is angled upward from the skid plate 62 to a height of 7/16" to ½" to form the gusset 31 in the middle of the hinge tape 30. The height can be varied depending on the width of the space between the panels 26 and 28. As the gusset 31 is formed in the tape, the space between the edges of the panels 26 and 28 must be decreased as the gusset is formed. If heat is required to crease the tape, the crease plate 58 can be heated as described above.

Figure 7:
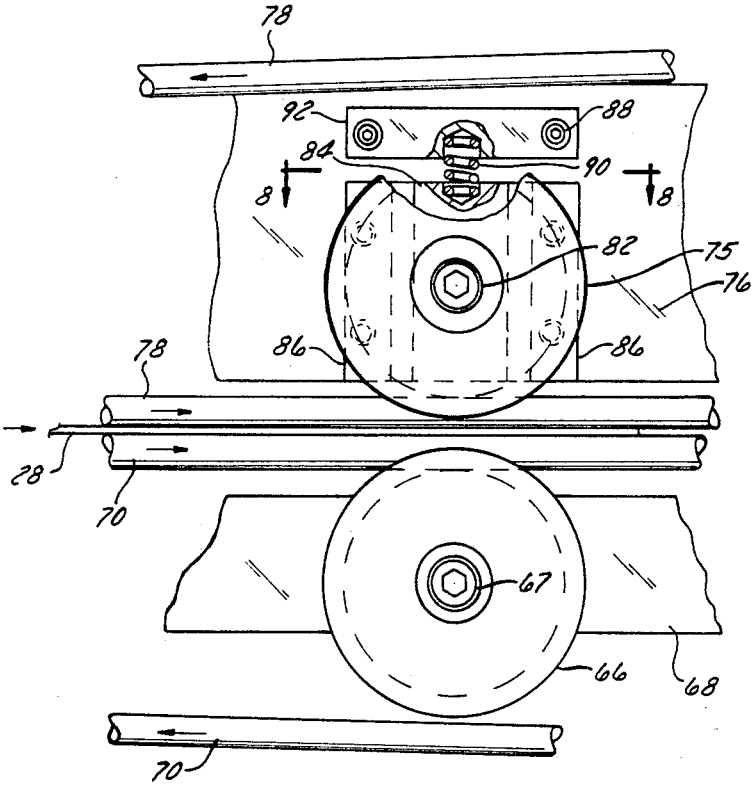
FIG. 7 is a view of a portion of the drive belt for the skewed panel with a portion of the drive wheels broken away to show the spring mount for the drive wheel.

In this regard, means are provided to skew or twist the second panel 28 so that it moves toward the first panel as the gusset is forced upward by the plate 58. Such means is in form of belt drive assemblies 64*a* and 64*b* provided above and below the driven panel 28. The bottom drive assembly 64*a* includes a number of sheaves 66 supported by pins 67 for rotary motion on a bar 68 (FIG. 7). A rubber drive band 70 is aligned with the top of the sheaves 66 and is wrapped around a drive roll 72 mounted on a shaft 74 provided beneath the sheaves 66. The upper drive assembly 64*b* also includes a number of sheaves 75, which correspond to the sheaves 66, mounted for rotary motion on pins 82 provided on a support bar 76. A rubber drive band 78 is aligned with the bottom of the sheaves 75 and is wrapped around a drive roll 80 mounted on a shaft 81 located above the sheaves 74. Means are provided to bias the sheaves 75 toward the sheaves 66 to provide sufficient pressure between the bands 78 and 70 to drive the second panel 28 toward the first panel 26.

Figure 8:
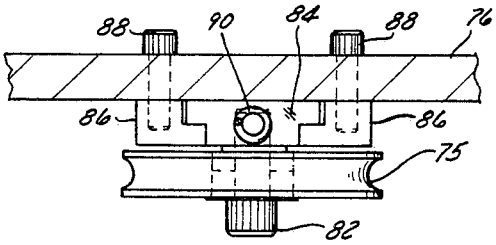
FIG. 8 is a sectional view taken on line 8—8 of FIG. 7 showing the mount for the drive wheel.

In this regard, and referring to FIGS. 7 and 8, it should be noted that the sheaves 75 are mounted for rotary movement on the pins 82 which are supported on a T-block 84. The T-block 84 is mounted for sliding motion in a pair of L-shaped retainer blocks 86 secured to the bar 76 by screws 88. A spring 90 is located between the top of the T-bar 84 and a fixed bar 92 is also secured to the bar 76 by screws 88. The spring 90 thus provides a bias force between the two bands 78 and 70 to drive the panel 28.

Figure 9:
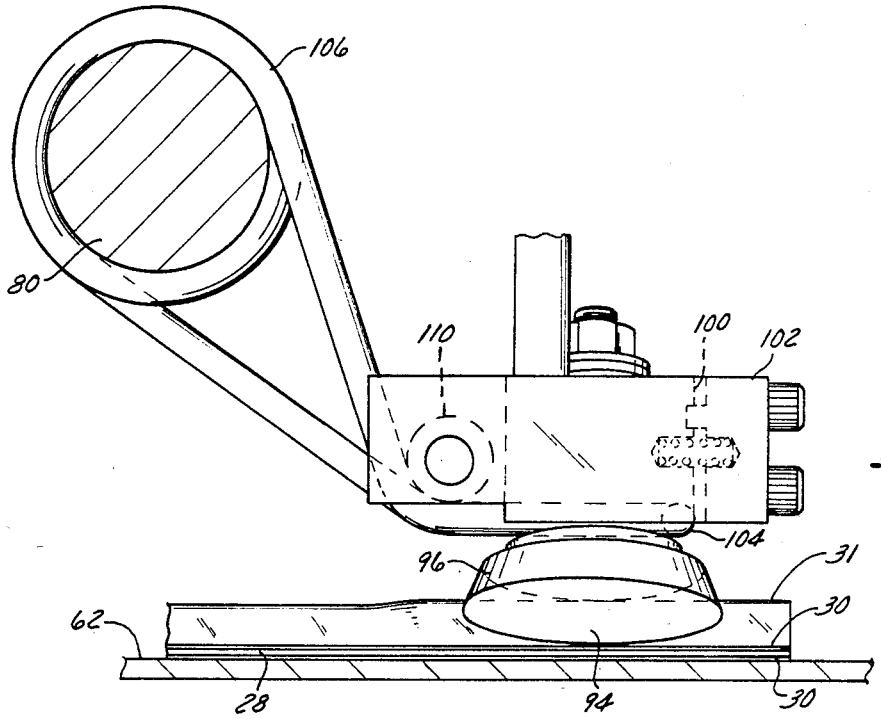
FIG. 9 is a side elevation view of the pinch wheels for creasing the folded hinge.
Figure 10:
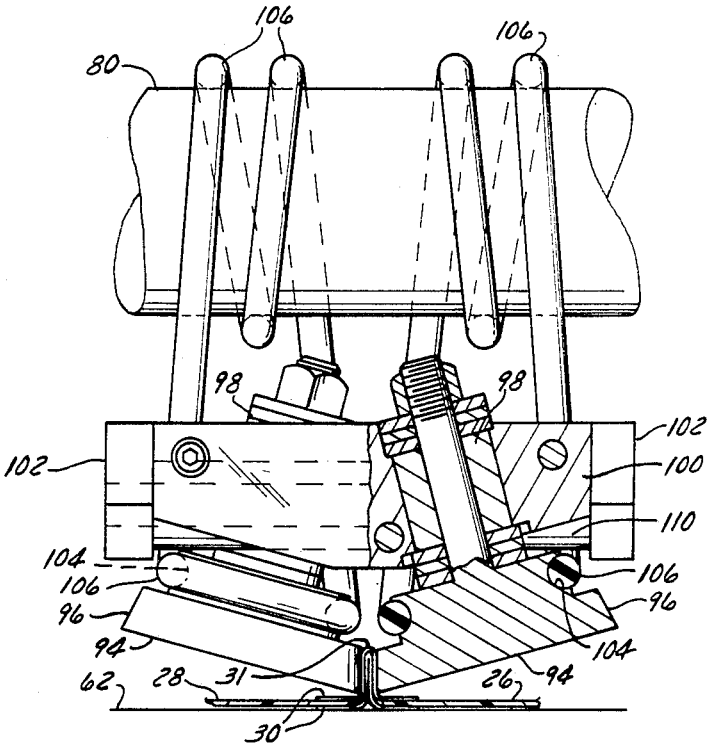
FIG. 10 is a front view of FIG. 9 partly broken away to show the position of the pinch wheels in creasing the corners of the gusset.

After the hinge 30 has been folded to form the gusset 31, a final crease is applied to the gusset by means of a pair of pinch wheels 94 located at the creaser station 18. In this regard and referring to FIGS. 9 and 10, the gusset 31 formed in the tape 30 is shown squeezed between the pinch wheels 94. As seen in FIG. 10, the wheels 94 are provided with a face 96 offset at an acute angle so that the gusset 31 is pinched between the faces 96 of the wheels. The crease at the bottom of the gusset 31 is pinched by the lower edge of the pinch wheel.

More particularly, the pinch wheels 94 are mounted for rotary movement in bearings 98 located in a housing 100 mounted on a crossbar 102. An annular groove 104 is provided on each of the pinch wheels. The pinch wheels are driven by means of rubber bands or belts 106 which are wrapped around drive roller 80 and around the annular groove 104 in the wheels 94. An idler roll 110 is provided on the back of the housing 100. The pinch wheels 94 can be heated as described above if required to set the tape.

Figure 11:
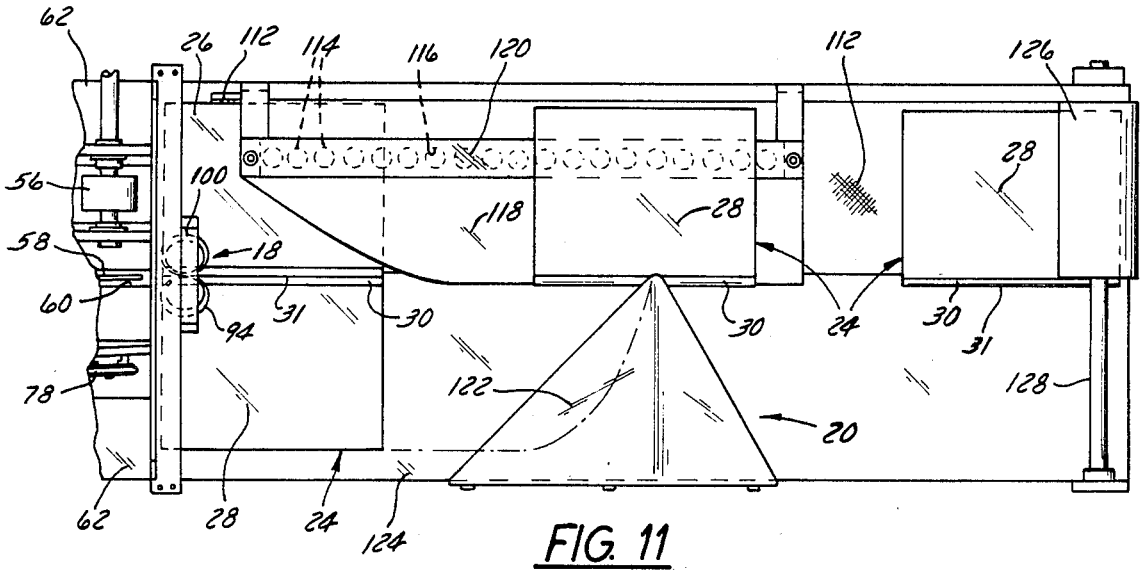
FIG. 11 is a plan view of the file folding section of the folding assembly.
Figure 12:
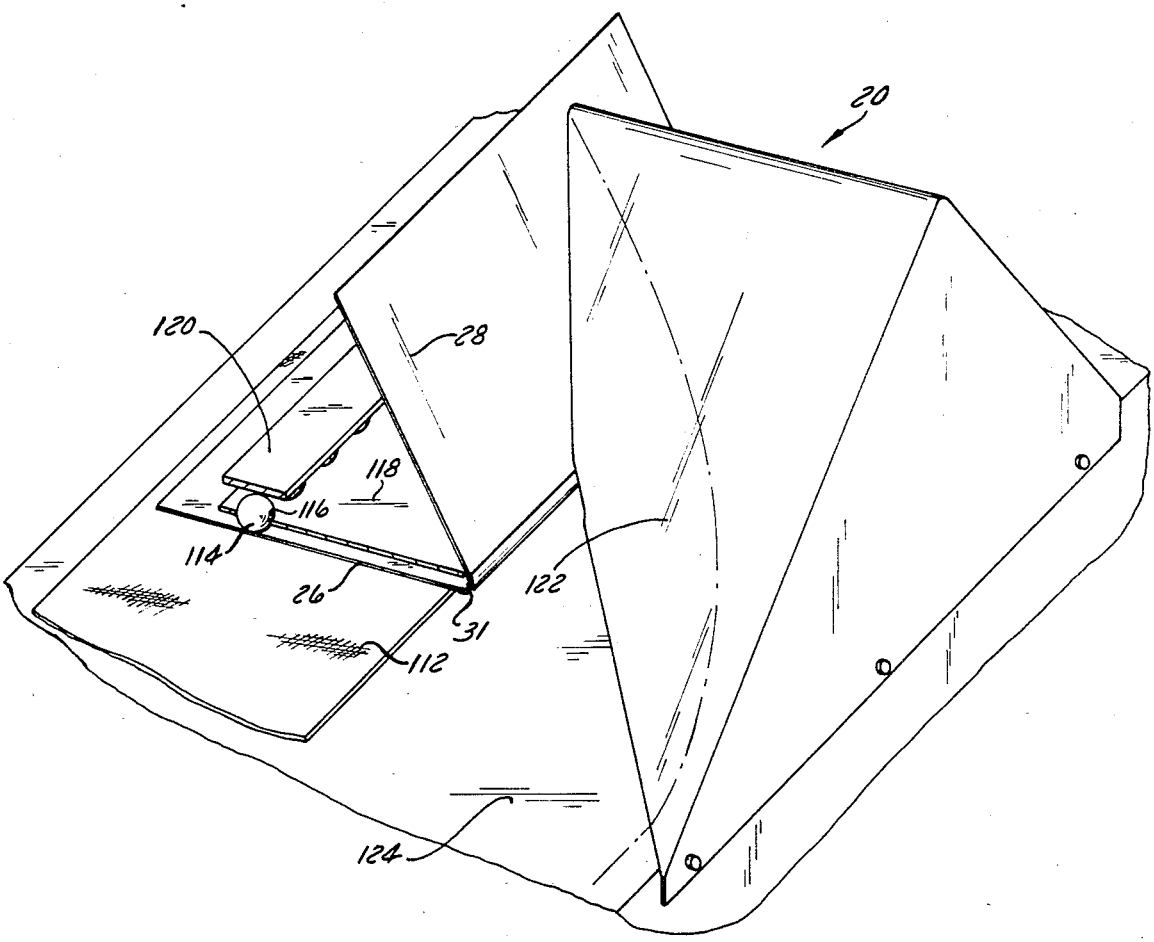
FIG. 12 is a perspective view showing one of the file folders being folded as it moves through the folding section.

As the file folder emerges from the pinch wheels, the folder is moved into the file folding station 20. Referring to FIGS. 11 and 12, the first panel 26 is carried through the file folding station by means of a first belt 112. The drive panel 26 is pressed against the drive belt I12 by means of a number of free floating balls 114 provided in a slot 116 in a plate 118. A cover strip 120 is supported over the balls 116 to maintain the balls in the groove 116.

The driven panel 28 is folded over the first panel 26 by means of an angularly offset panel 122 supported on a skid plate 124. The second panel rides up the edge of the panel 122 until it has been folded far enough to fall by its own weight on top of the first panel 26.

A final crease is applied to the hinge at the final crease station 22 by means of a pressure roll 126 mounted on a shaft 128. The pressure roll 126 is positioned to roll on the drive roll 130 for the belt 112. The drive roll 130 is mounted on a shaft 132.

The embodiments of the invention in which an exclusive property or privilege is claimed, are defined as follows:

1. An inline hinged file folder folding assembly for creasing the flexible hinge provided between two file folder panels, said assembly comprising a base, means mounted on said base for scoring the hinge of the file folder, means mounted on said base adjacent the said scoring means for creasing the hinge along said score line to form a gusset, and means mounted on said base adjacent to said creasing means for folding one of the file folder panels over the other file folder panel with the gusset folded within the folded file folder said creasing means being located between said scoring means and said folding means.

2. The assembly according to claim 1 including means for driving the file folder in sequence through said scoring means, creasing means and folding means, wherein said driving means includes a pair of flat drive wheels engaging one of said file folder panels and a part of convex wheels engaging the other one of said file folder panels.

3. The assembly according to claims 1 or 2 wherein said creasing means includes a creasing plate of increasing height mounted on said base whereby the hinge will be creased to form the gusset as the hinge moves up the creasing plate.

4. The assembly according to claim 3 wherein said creasing means includes a pair of drive belt assemblies disposed to move one of the file folder panels toward the other panel as the gusset is formed in the hinge.

5. The assembly according to claim 1 including pinch means mounted on said base in a position to squeeze said gusset formed by said creasing means.

6. The assembly according to claim 5 wherein said pinch means includes a pair of wheels having angularly offset surfaces positioned to engage the sides of the gusset.

7. The assembly according to claim 6 wherein said folding means includes a plate of substantially increasing height whereby said panel rides up the plate until the panel folds over the other panel.

8. The assembly according to claim 7 including means on said base downstream from said folding means for squeezing the folded hinge.

9. An inline folding assembly for forming a gusset in the tape hinge between the panels of a file folder, the assembly comprising means for scoring the hinge of the file folder, means operatively positioned adjacent to said scoring means to crease the hinge of the file folder along the score lines to form a gusset between the file folder panels, and means adjacent to said creasing means for folding the file folder with the gusset between the file folder panels said creasing means being located between said scoring means and said folding means.

10. The folding assembly according to claim 9 including means located between said creasing means and said folding means for squeezing the gusset formed between the panels prior to folding the file folder.

11. The folding assembly according to claim 9 including means for driving the file folder through said scoring means, said creasing means and said folding means.

12. The folding assembly according to claims 9 or 10 wherein said creasing means includes a crease plate of increasing height whereby said hinge is creased as the file folder is moved over the plate.

13. The folding assembly according to claim 12 including means for driving said file folder continuously over said creasing means.

14. The folder assembly according to claim 13 wherein said driving means includes means for moving one of said file folder panels toward the other as the hinge is creased to form the gusset.

15. The folding assembly according to claim 14 including means located between said creasing means and said folding means for squeezing said gusset formed between the panels of the file folder prior to folding the file folder.

* * * * *